US012680276B2

(12) United States Patent
Nishikawa et al.

(10) Patent No.: US 12,680,276 B2
(45) Date of Patent: Jul. 14, 2026

(54) CONSTRUCTION MACHINE

(71) Applicant: HITACHI CONSTRUCTION MACHINERY CO., LTD., Tokyo (JP)

(72) Inventors: Shinji Nishikawa, Kasumigaura (JP); Ryohei Yamashita, Sumida-ku (JP); Akihiro Narazaki, Tsukuba (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 375 days.

(21) Appl. No.: 18/278,671

(22) PCT Filed: Dec. 16, 2021

(86) PCT No.: PCT/JP2021/046639
§ 371 (c)(1),
(2) Date: Aug. 24, 2023

(87) PCT Pub. No.: WO2022/209046
PCT Pub. Date: Oct. 6, 2022

(65) Prior Publication Data

US 2024/0052600 A1 Feb. 15, 2024

(30) Foreign Application Priority Data

Mar. 31, 2021 (JP) ..... 2021-061270

(51) Int. Cl.
*E02F 9/26* (2006.01)
*E02F 9/20* (2006.01)
*E02F 9/24* (2006.01)

(52) U.S. Cl.
CPC ..... *E02F 9/26* (2013.01); *E02F 9/205* (2013.01); *E02F 9/24* (2013.01)

(58) Field of Classification Search
CPC ..... E02F 9/26; E02F 9/205; E02F 9/24
See application file for complete search history.

(56) References Cited

U.S. PATENT DOCUMENTS 4,621,375 A * 11/1986 Simnovec ..... G08C 17/00 455/352
6,148,548 A * 11/2000 Tohji ..... E02F 9/2285 37/348

(Continued)

FOREIGN PATENT DOCUMENTS

JP 06-311570 A 11/1994
JP 08-255019 A 10/1996

(Continued)

OTHER PUBLICATIONS

International Search Report of PCT/JP2021/046639 dated Jan. 25, 2022.

(Continued)

*Primary Examiner* — Gertrude Arthur Jeanglaude
(74) *Attorney, Agent, or Firm* — MATTINGLY & MALUR, PC

(57) ABSTRACT

Provided are a machine controller that controls operation of the hydraulic excavator, an external operation controller that executes control of unattended operation that does not require operation through riding of an operator in a cab, by generating a control signal according to an operation signal received from the external through a communication terminal and sending out the control signal to the machine controller, an operation indicator light that indicates that the unattended operation of the hydraulic excavator is normally in operation, and an approach permission indicator light that indicates permission of approach of a worker to the hydraulic excavator. The external operation controller, according to information collected into the machine controller, turns on the operation indicator light when determining that the hydraulic excavator is normally operating, and turns on the approach permission indicator light when determining that approach of the worker to the hydraulic excavator is permissible.

8 Claims, 10 Drawing Sheets

(56) References Cited

U.S. PATENT DOCUMENTS

| | | | | |
|---|---|---|---|---|
| 2014/0058635 | A1* | 2/2014 | Furukawa | B60R 16/02 701/50 |
| 2014/0330490 | A1* | 11/2014 | Aoki | E02F 9/2079 701/50 |
| 2020/0208381 | A1 | 7/2020 | Minagawa et al. | |

FOREIGN PATENT DOCUMENTS

| | | | |
|---|---|---|---|
| JP | 09-217383 | A | 8/1997 |
| JP | 2001-090118 | A | 4/2001 |
| JP | 2001-200553 | A | 7/2001 |
| JP | 2002-47690 | A | 2/2002 |
| JP | 2002-180503 | A | 6/2002 |
| JP | 2005-350930 | A | 12/2005 |
| JP | 2019-068236 | A | 4/2019 |
| WO | 2016/029246 | A1 | 3/2016 |

OTHER PUBLICATIONS

Extended European Search Report received in corresponding European Application No. 21935195.4 dated Mar. 27, 2025.

International Preliminary Report on Patentability received in corresponding International Application No. PCT/JP2021/046639 dated Oct. 12, 2023.

* cited by examiner

FIG. 3

RELATION BETWEEN INDICATION COLOR AND USE PURPOSE (TURN-ON CONDITION) OF EACH STATE INDICATOR LIGHT

| | 201 NAME | 202 INDICATION COLOR | 203 USE PURPOSE (TURN-ON CONDITION) |
|---|---|---|---|
| 201a | WORK INDICATOR LIGHT | YELLOW | TURNED ON WHEN ENGINE STATE IS OPERATING |
| 201b | WARNING INDICATOR LIGHT | RED | TURNED ON WHEN ABNORMALITY THAT POSES OBSTACLE TO UNATTENDED OPERATION (REMOTE OPERATION, AUTOMATIC OPERATION) HAS OCCURRED |
| 201c | COMMUNICATION INDICATOR LIGHT | BLUE | TURNED ON WHEN COMMUNICATION BETWEEN MACHINE BODY AND REMOTE OPERATION DEVICE OR CONTROL ROOM IS BEING NORMALLY EXECUTED |
| 201d | OPERATION INDICATOR LIGHT | GREEN | TURNED ON WHEN UNATTENDED OPERATION (REMOTE OPERATION, AUTOMATIC OPERATION) IS NORMALLY OPERATING |
| 201e | APPROACH PERMISSION INDICATOR LIGHT | GREEN | TURNED ON WHEN APPROACH OF WORKER TO CONSTRUCTION MACHINE IS PERMITTED |
| 201f | ACTION REQUEST INDICATOR LIGHT | BLUE | TURNED ON WHEN RIDING OF WORKER (OPERATOR, WORKER IN SURROUNDINGS) IN CAB AND SPECIFIC ACTION TO WORKER WHO RIDES ARE SUPPLIED |

FIG. 5

RELATION BETWEEN CONTROL STATE AND POSSIBILITY OF MACHINE BODY OPERATION

| | 211 CONTROL STATE | 212 POSSIBILITY OF MACHINE BODY OPERATION BY RIDING OPERATOR | 213 POSSIBILITY OF MACHINE BODY OPERATION BY REMOTE (EXTERNAL) COMMAND |
|---|---|---|---|
| 311 | ATTENDED OPERATION STATE | POSSIBLE | NOT POSSIBLE (IMPOSSIBLE) |
| 321 | UNATTENDED OPERATION TEMPORARILY-DEACTIVATED STATE | POSSIBLE | NOT POSSIBLE (IMPOSSIBLE) |
| 322 | UNATTENDED OPERATION STANDBY STATE | NOT POSSIBLE (IMPOSSIBLE) | NOT POSSIBLE (IMPOSSIBLE) |
| 323 | UNATTENDED OPERATION WORK STATE | NOT POSSIBLE (IMPOSSIBLE) | POSSIBLE |
| 324 | UNATTENDED OPERATION FORCIBLY-STOPPED STATE | POSSIBLE | NOT POSSIBLE (IMPOSSIBLE) |

FIG. 7

RELATION BETWEEN INDICATION COLOR AND TURN-ON CONDITION OF EACH STATE INDICATOR LIGHT
(ATTENDED OPERATION STATE: TURN-ON CONTROL PATTERN 1)

230

| | 221 NAME | 222 INDICATION COLOR | 223 TURN-ON CONDITION (STATE OF MACHINE BODY WHEN LIGHT IS TURNED ON) |
|---|---|---|---|
| 221a | WORK INDICATOR LIGHT | YELLOW | ENGINE STATE: IN OPERATION |
| 221b | WARNING INDICATOR LIGHT | RED | NONE (ALWAYS TURNED OFF) |
| 221c | COMMUNICATION INDICATOR LIGHT | BLUE | NONE (ALWAYS TURNED OFF) |
| 221d | OPERATION INDICATOR LIGHT | GREEN | NONE (ALWAYS TURNED OFF) |
| 221e | APPROACH PERMISSION INDICATOR LIGHT | GREEN | "ENGINE STATE: STOP" OR "LOCK VALVE: INTERRUPTION" |
| 221f | ACTION REQUEST INDICATOR LIGHT | BLUE | NONE (ALWAYS TURNED OFF) |

FIG. 8

RELATION BETWEEN INDICATION COLOR AND TURN-ON CONDITION OF EACH STATE INDICATOR LIGHT
(ATTENDED OPERATION STATE: TURN-ON CONTROL PATTERN 2)

231

| | 221 NAME | 222 INDICATION COLOR | 223 TURN-ON CONDITION (STATE OF MACHINE BODY WHEN LIGHT IS TURNED ON) |
|---|---|---|---|
| 221a | WORK INDICATOR LIGHT | YELLOW | ENGINE STATE: IN OPERATION |
| 221b | WARNING INDICATOR LIGHT | RED | NONE (ALWAYS TURNED OFF) |
| 221c | COMMUNICATION INDICATOR LIGHT | BLUE | NONE (ALWAYS TURNED OFF) |
| 221d | OPERATION INDICATOR LIGHT | GREEN | NONE (ALWAYS TURNED OFF) |
| 221e | APPROACH PERMISSION INDICATOR LIGHT | GREEN | NONE (ALWAYS TURNED OFF) |
| 221f | ACTION REQUEST INDICATOR LIGHT | BLUE | NONE (ALWAYS TURNED OFF) |

FIG. 9

RELATION BETWEEN INDICATION COLOR AND TURN-ON CONDITION OF EACH STATE INDICATOR LIGHT
(ATTENDED OPERATION STATE: TURN-ON CONTROL PATTERN 3)

232

| | 221 NAME | 222 INDICATION COLOR | 223 TURN-ON CONDITION (STATE OF MACHINE BODY WHEN LIGHT IS TURNED ON) |
|---|---|---|---|
| 221a | WORK INDICATOR LIGHT | YELLOW | ENGINE STATE: IN OPERATION |
| 221b | WARNING INDICATOR LIGHT | RED | NONE (ALWAYS TURNED OFF) |
| 221c | COMMUNICATION INDICATOR LIGHT | BLUE | NONE (ALWAYS TURNED OFF) |
| 221d | OPERATION INDICATOR LIGHT | GREEN | "ENGINE STATE: STOP" OR "LOCK VALVE: INTERRUPTION" |
| 221e | APPROACH PERMISSION INDICATOR LIGHT | GREEN | NONE (ALWAYS TURNED OFF) |
| 221f | ACTION REQUEST INDICATOR LIGHT | BLUE | NONE (ALWAYS TURNED OFF) |

FIG. 10

RELATION BETWEEN INDICATION COLOR AND TURN-ON CONDITION OF EACH STATE INDICATOR LIGHT (UNATTENDED OPERATION STATE)

| | 221 NAME | 222 INDICATION COLOR | 223 TURN-ON CONDITION (STATE OF MACHINE BODY WHEN LIGHT IS TURNED ON) |
|---|---|---|---|
| 221a | WORK INDICATOR LIGHT | YELLOW | ENGINE STATE: IN OPERATION |
| 221b | WARNING INDICATOR LIGHT | RED | CONTROL STATE: UNATTENDED OPERATION FORCIBLY-STOPPED STATE |
| 221c | COMMUNICATION INDICATOR LIGHT | BLUE | "CONTROL STATE: UNATTENDED OPERATION TEMPORARILY-DEACTIVATED STATE, UNATTENDED OPERATION STANDBY STATE, UNATTENDED OPERATION WORK STATE, OR UNATTENDED OPERATION FORCIBLY-STOPPED STATE" AND "NETWORK CONNECTION BETWEEN MACHINE BODY AND CONTROL ROOM: NORMAL" |
| 221d | OPERATION INDICATOR LIGHT | GREEN | CONTROL STATE: UNATTENDED OPERATION WORK STATE |
| 221e | APPROACH PERMISSION INDICATOR LIGHT | GREEN | "CONTROL STATE: UNATTENDED OPERATION TEMPORARILY-DEACTIVATED STATE, UNATTENDED OPERATION STANDBY STATE, OR UNATTENDED OPERATION FORCIBLY-STOPPED STATE" AND ""ENGINE STATE: STOP" OR "LOCK VALVE: INTERRUPTION"" |
| 221f | ACTION REQUEST INDICATOR LIGHT | BLUE | "OCCURRENCE OF ABNORMAL STATE IN WHICH WORKER IS REQUESTED TO RIDE IN CAB AND MAKE SPECIFIC ACTION (ONE CONDITION OF UNATTENDED OPERATION FORCIBLY-STOPPED STATE)" OR "ACTION REQUEST INDICATOR LIGHT TURN-ON SIGNAL: RECEIVED"HT TURN-ON SIGNAL: RECEIVED" |

CONSTRUCTION MACHINE

TECHNICAL FIELD

The present invention relates to a construction machine.

BACKGROUND ART

In operation of a construction machine typified by a hydraulic excavator, in order to suppress careless approach of a worker in the surroundings to the construction machine that operates at a work site, for example, that the construction machine is in operation is informed by using a rotating light or the like and the worker in the surroundings is urged to be careful.

For example, a technique described in patent document 1 is known as a technique for attracting attention through aggressively notifying a worker in the surroundings about the state of the machine body by a light emitter installed along the shape of a construction machine to allow recognition of the construction machine even in the nighttime. Patent document 1 discloses a work vehicle in which linear light emitters are mounted on an outside surface of an upper swing structure in a work vehicle including a lower track structure, the upper swing structure that is swingably mounted on an upper part of the lower track structure and on which a cab is mounted, and a work implement mounted on the upper swing structure in such a manner as to be capable of freely looking up and down.

Furthermore, for example, a technique described in patent document 2 is known as a technique for checking an abnormality of the machine body in automatic operation from a remote place when a worker does not ride thereon as in remote operation and the automatic operation, by an indicator light with which the machine body is equipped. Patent document 2 discloses an automatic travelling vehicle including a frame of the vehicle, an engine placed on the frame, wheels driven by power of the engine, a travelling operation device, a controller that controls the travelling operation device, a body laid on the vehicle, an indicator lamp with which a body upper part is equipped, an operation panel having a switch that makes switching between a manual mode by attended operation and an auto mode by unattended operation, and a remote controller that makes a command of switching of the operation mode, activation, and stop by remote operation.

PRIOR ART DOCUMENT

Patent Documents

Patent Document 1: JP-2002-180503-A
Patent Document 2: JP-1996-255019-A

SUMMARY OF THE INVENTION

Problem to be Solved by the Invention

Incidentally, when a work machine executes unattended operation (remote operation, automatic operation), it is conceivable that there arise a need for a worker in the surroundings of the construction machine to inevitably approach the machine body in the unattended operation or a need to cause work by the construction machine to be suspended.

At this time, for example, even in the case in which it is possible for the worker in the surroundings to forcibly stop the construction machine in the unattended operation (remote operation, automatic operation), if actually the unattended operation is stopped, the work by the unattended operation is unintentionally suspended or stopped and unnecessary lowering of the work efficiency is caused.

Even in the case of causing a manager who remotely manages the unattended operation (remote operation, automatic operation) of the construction machine to temporarily suspend the unattended operation by some kind of means of communication, if that the machine body is in the state in which it does not start to move is not conveyed to the worker in the surrounding, the worker in the surroundings cannot confirm the safety and thus cannot approach the work machine, so that the lowering of the work efficiency is caused. Moreover, it is also conceivable that, even in the case in which the unattended operation is not suspended, the worker in the surroundings falsely recognizes suspension of the unattended operation from the state in which the work machine is not moving and carelessly approaches the construction machine.

Furthermore, when a work machine executes unattended operation (remote operation, automatic operation), a manager who monitors the unattended operation needs to grasp the operation state of the work machine in order to execute safety management and work management. The construction machine that executes the unattended operation is connected to a controller operated by the manager by network communication, and the manager can grasp the state of the machine body by a monitor or the like in a control room if the network connection is normal. However, it becomes impossible to check the operation state of the work machine by the monitor or the like when the network communication is interrupted.

The present invention is what is made in view of the above description and intends to provide a construction machine that can simply notify a worker in the surroundings and a manager about the operation state of a machine body and ensure both the safety and the work efficiency of the worker in the surroundings of the machine body and the manager.

Means for Solving the Problem

The present application includes a plurality of means to solve the above-described problem. To cite one example thereof, a construction machine that executes work at a construction work site includes a machine controller that controls operation of the construction machine, an external operation controller that executes control of unattended operation that does not require operation through riding of an operator in a cab, by generating a control signal according to an operation signal received from the external through a communication terminal and sending out the control signal to the machine controller, an operation indicator light that indicates that the unattended operation of the construction machine is normally in operation, and an approach permission indicator light that indicates permission of approach of a worker to the construction machine. The external operation controller is configured to, according to information collected into the machine controller, execute control to turn on the operation indicator light when determining that the construction machine is normally operating, and execute control to turn on the approach permission indicator light when determining that approach of the worker to the construction machine is permissible.

Advantages of the Invention

According to the present invention, the operation state of the machine body can be simply notified to the worker in the surroundings and the manager and both the safety and the work efficiency of the worker in the surroundings of the machine body and the manager can be ensured.

BRIEF DESCRIPTION OF THE DRAWINGS

FIG. 3 is a diagram illustrating the relation among the name of each state indicator light, the indication color, and the use purpose (turn-on condition).

FIG. 5 is a diagram illustrating the relation between the possibility of machine body operation by an operator who rides and the possibility of machine body operation by a remote (external) command, in each control state.

FIG. 7 is a diagram illustrating a control table in the control pattern (turn-on control pattern 1) of the state indicator lights in the attended operation state.

FIG. 8 is a diagram illustrating a control table in the control pattern (turn-on control pattern 2) of the state indicator lights in the attended operation state.

FIG. 9 is a diagram illustrating a control table in the control pattern (turn-on control pattern 3) of the state indicator lights in the attended operation state.

FIG. 10 is a diagram illustrating a control table in an unattended operation state.

MODES FOR CARRYING OUT THE INVENTION

An embodiment of the present invention will be described below with reference to FIG. 1 to FIG. 10.

In the present embodiment, description will be made through exemplifying a hydraulic excavator equipped with a front work implement as one example of a construction machine. However, the present invention can be applied also in other construction machines.

Figure 1:
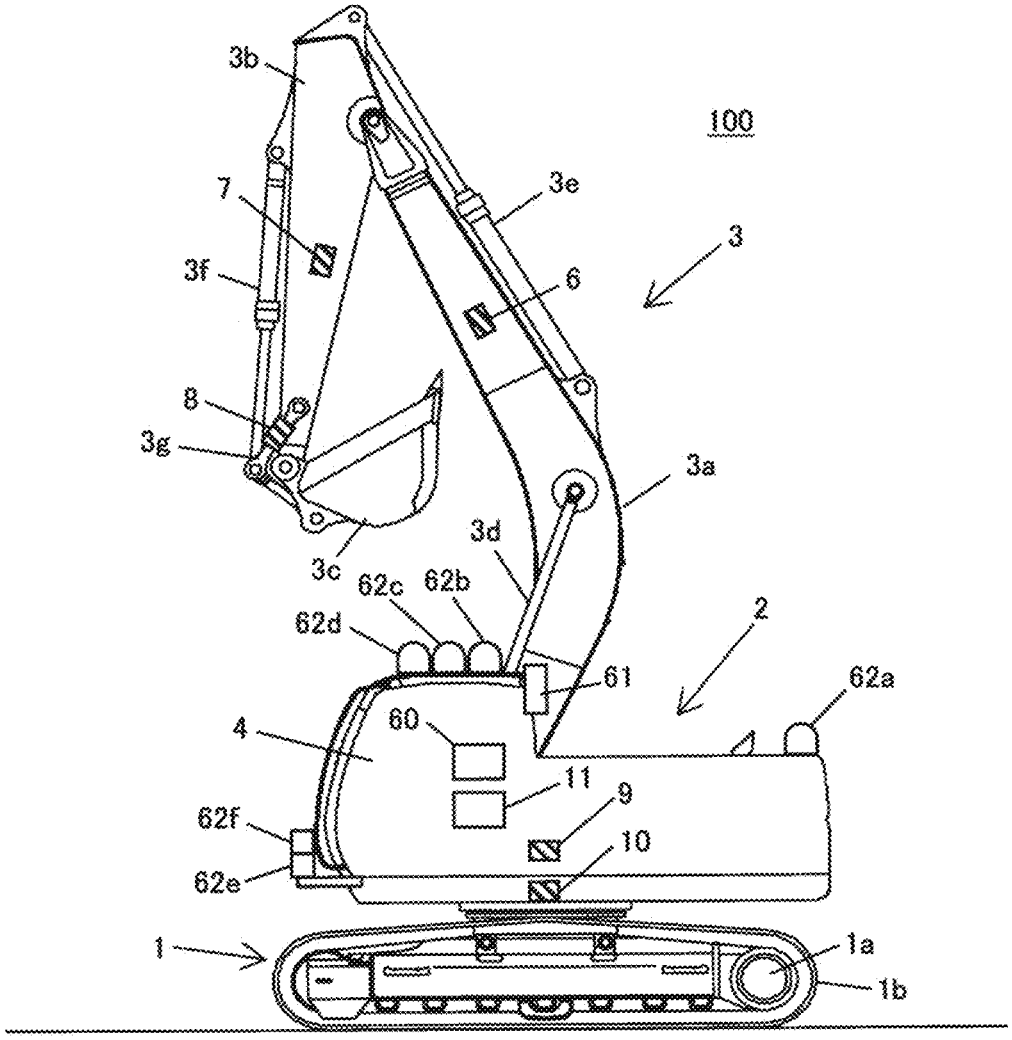
FIG. 1 is a side view schematically illustrating the appearance of a hydraulic excavator that is one example of a construction machine.

FIG. 1 is a side view schematically illustrating the appearance of the hydraulic excavator that is one example of the construction machine according to the present embodiment. Furthermore, FIG. 2 is a functional block diagram that extracts and illustrates a hydraulic system and a control system of the construction machine together with a related configuration.

In FIG. 1, a hydraulic excavator 100 is roughly composed of a lower track structure 1 of a crawler type, an upper swing structure 2 disposed swingably relative to the lower track structure 1, a front work implement 3 disposed pivotally in the vertical direction relative to the upper swing structure 2, and a cab 4 disposed at an upper part of the front side of the upper swing structure 2 for allowing an operating person (operator) to ride therein and execute various operations of the hydraulic excavator 100. The lower track structure 1 and the upper swing structure 2 configure the machine body of the hydraulic excavator 100.

The lower track structure 1 includes a pair of left and right travelling hydraulic motors 1*a* that are hydraulic actuators and crawlers 1*b* each wound around the travelling hydraulic motor 1*a* in the front-rear direction. The lower track structure 1 executes travelling operation forward or rearward by rotationally driving each crawler 1*b* independently by each travelling hydraulic motor 1*a* through a speed reduction mechanism that is not illustrated and so forth.

Figure 2:
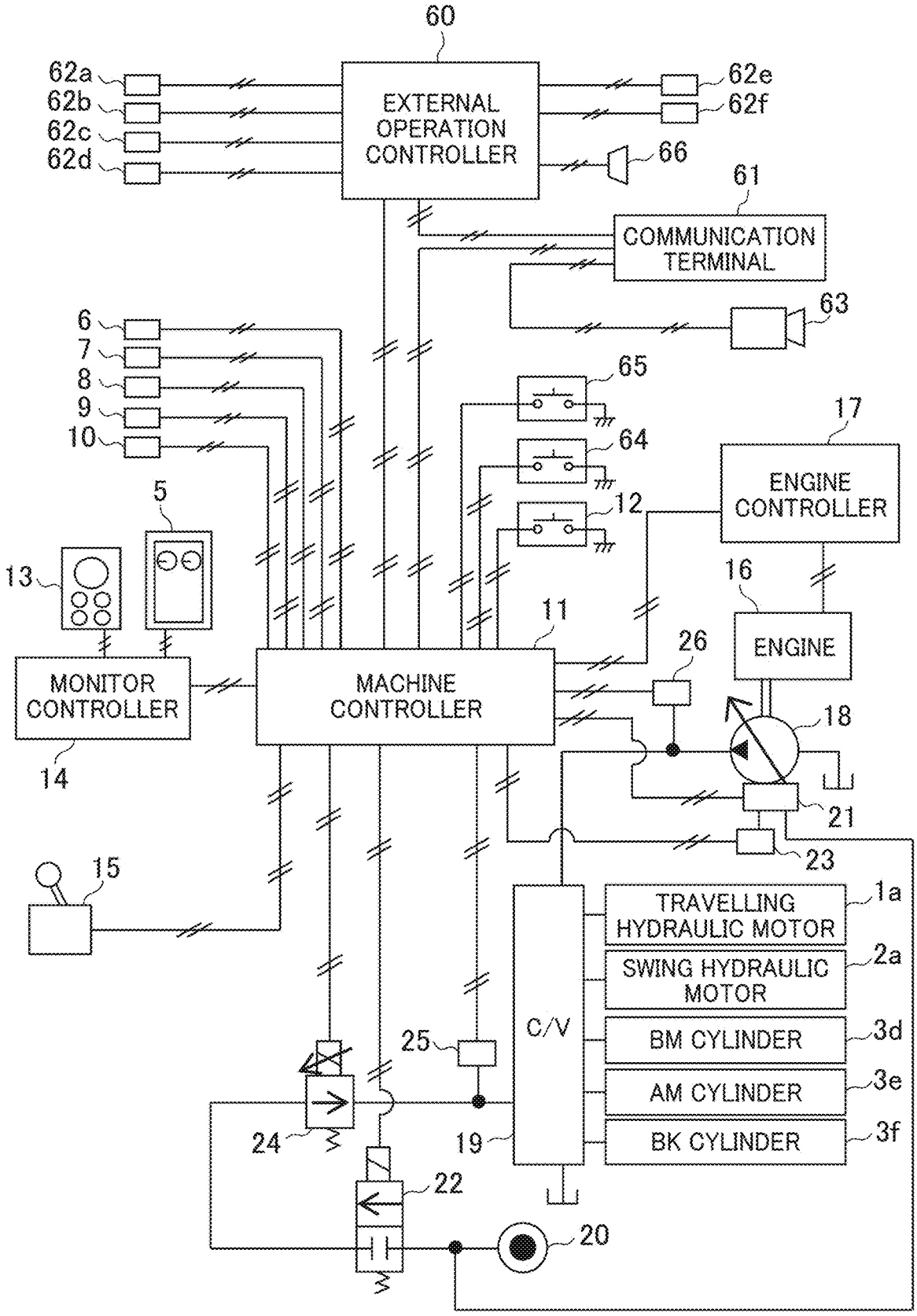
FIG. 2 is a functional block diagram that extracts and illustrates a hydraulic system and a control system of the construction machine together with a related configuration.

The upper swing structure 2 includes a hydraulic system of the hydraulic excavator 100 and a related mechanism thereof, such as a prime mover such as an engine 16, a hydraulic pump 18, and a swing hydraulic motor 2*a* (see FIG. 2). The upper swing structure 2 executes swing operation in the right direction or the left direction relative to the lower track structure 1 by the swing hydraulic motor 2*a* that is a hydraulic actuator.

The front work implement 3 is an articulated type configured through joining a plurality of front components (boom 3*a*, arm 3*b*, and bucket (work equipment) 3*c*) that each pivot in the vertical direction. The base end of the boom 3*a* is supported by a front part of the upper swing structure 2 pivotally in the vertical direction. One end of the arm 3*b* is supported by an end part (tip) of the boom 3*a* different from the base end thereof pivotally in the vertical direction. The bucket 3*c* as work equipment is supported by the other end of the arm 3*b* pivotally in the vertical direction. The boom 3*a*, the arm 3*b*, and the bucket 3*c* are rotationally driven by a boom cylinder 3*d*, an arm cylinder 3*e*, and a bucket cylinder 3*f*, respectively, that are hydraulic actuators.

The front work implement 3 is provided with an angle sensor 6 (boom angle sensor) that senses the angle of the boom 3*a*, an angle sensor 7 (arm angle sensor) that senses the angle of the arm 3*b*, and an angle sensor 8 (bucket angle sensor) that senses the angle of the bucket 3*c*. The angle sensors 6, 7, and 8 are, for example, IMU (Inertial Measurement Unit) and can calculate the relative angle of the boom 3*a*, the arm 3*b*, the bucket 3*c*, and the upper swing structure 2 on the basis of sensing results from the angle sensors 6 to 8.

Furthermore, on the frame of the upper swing structure 2, an inclination sensor 9 that senses the front-rear direction angle (pitch angle) and the left-right direction angle (roll angle) of the machine body is attached. A swing angle sensor 10 that senses the relative angle (swing angle) of the upper swing structure 2 relative to the lower track structure 1 is attached to a center joint (not illustrated) that links the lower track structure 1 and the upper swing structure 2. The inclination sensor 9 is an acceleration sensor, IMU, or the like.

Inside the cab 4, a display device 5 such as a liquid crystal monitor on which various meters and machine body information are displayed to allow the operator to check the status of the hydraulic excavator 100 is disposed.

A machine controller 11 that controls operation of the whole of the hydraulic excavator 100 is mounted inside the cab 4. The machine controller 11 has a function of input of signals of various sensors for deciding operation of the hydraulic excavator, a signal output function for driving pumps, control valves, and so forth, a function of communication with other in-machine controllers such as an engine controller, and so forth.

The angle sensors 6, 7, and 8, the inclination sensor 9, and the swing angle sensor 10 are electrically connected to this machine controller 11. The machine controller 11 computes the posture of the hydraulic excavator (angle with respect to the ground regarding the boom 3*a*, the arm 3*b*, and the bucket 3*c* and the relative angle between the lower track structure 1 and the upper swing structure 2) by using information of these various sensors for posture computation, and uses the computation result for a machine control function and an area limiting function and uses the computation result for remote maneuvering and automatic operation.

Furthermore, an external operation controller 60 that transmits a drive request of pumps, control valves, and so forth to the machine controller 11 at the time of unattended operation such as remote maneuvering or automatic operation is disposed in the cab 4 of the hydraulic excavator 100. At the time of unattended operation, the machine controller 11 that has received this drive request signal drives pumps, control valves, and so forth. This makes it possible to drive hydraulic actuators (boom cylinder 3*d*, arm cylinder 3*e*, bucket cylinder 3*f*, travelling hydraulic motors 1*a*, swing hydraulic motor 2*a*, and so forth) of the hydraulic excavator 100 even when operation of an operation device 15 by the operator who rides is not executed.

A communication terminal 61 is disposed at the external of the cab 4 of the hydraulic excavator 100 for communication with the external at the time of unattended operation. This allows mutual communication with a worker communication terminal (not illustrated) that the worker in the surroundings possesses, a remote maneuvering device (not illustrated) operated by a remote maneuvering operator, and a control room (not illustrated) in which the state of the machine body is remotely monitored and operation of the machine body is remotely operated.

The hydraulic excavator 100 is provided with state indicator lights 62*a*, 62*b*, 62*c*, 62*d*, 62*e*, and 62*f* as indicators for notifying the surroundings of the state of the machine body. The state indicator lights 62*a*, 62*b*, 62*c*, 62*d*, 62*e*, and 62*f* are each a rotating light of a single color. Hereinafter, the plurality of state indicator lights 62*a*, 62*b*, 62*c*, 62*d*, 62*e*, and 62*f* will be described collectively as the state indicator lights 62.

FIG. 3 is a diagram illustrating the relation among the name of each state indicator light, the indication color, and the use purpose (turn-on condition). In FIG. 3, the relation among a name 201 of each state indicator light, an indication color 202, and a use purpose (turn-on condition) 203 is illustrated in a table format regarding each of names 201*a* to 201*f* of the respective state indicator lights.

The state indicator lights 62 with which the hydraulic excavator 100 is equipped are composed of

- the state indicator light 62*a* given a name of "work indicator light" (name 201*a*) (hereinafter, referred to as the work indicator light 62*a*),
- the state indicator light 62*b* given a name of "warning indicator light" (name 201*b*) (hereinafter, referred to as the warning indicator light 62*b*),
- the state indicator light 62*c* given a name of "communication indicator light" (name 201*c*) (hereinafter, referred to as the communication indicator light 62*c*),
- the state indicator light 62*d* given a name of "operation indicator light" (name 201*d*) (hereinafter, referred to as the operation indicator light 62*d*),
- the state indicator light 62*e* given a name of "approach permission indicator light" (name 201*e*) (hereinafter, referred to as the approach permission indicator light 62*e*), and
- the state indicator light 62*f* given a name of "action request indicator light" (name 201*f*) (hereinafter, referred to as the action request indicator light 62*f*).

For the work indicator light 62*a*, yellow is employed to notify the surroundings that the machine body is in operation and call attention thereto.

For the warning indicator light 62*b*, red is employed to notify that an abnormality or breakdown has occurred or the current state is an emergency state.

For the communication indicator light 62*c*, blue is employed as one of colors that represent an ordinary state.

For the operation indicator light 62*d*, green is employed as a color that represents a normal state.

For the approach permission indicator light 62*e*, green is employed as a color that represents a safe state in which the worker in the surroundings is permitted to approach the machine body.

For the action request indicator light 62*f*, blue is employed as a color for requesting the worker in the surroundings to approach the machine body (forcing the worker to make action).

Many kinds of information exist as the information desired to be notified from the machine body to the manager of unattended operation or the worker in the surroundings as described above. However, if the number of colors used becomes too large, easiness of recognition lowers due to that. Therefore, it is preferable to avoid excessively increasing the colors used unnecessarily.

Furthermore, in the case in which indication by characters on a liquid crystal panel or the like is employed, more accurate information can be transmitted whereas there are concerns that it takes a long time until the worker recognizes the contents and that the direction in which the indication can be visually recognized is limited.

In the present embodiment, four colors of red, yellow, blue, and green, which are colors used in industrial machinery in general, are used. Also as meanings assigned to the respective colors, green is assigned to meanings of "normal" and "permission" and blue is assigned to a meaning of "instruction (approach request)" to the worker in the surroundings. Therefore, false recognition, confusion, and so forth of the meanings are less liable to occur.

The mounting position of each of the state indicator lights 62 is also disposed as follows in consideration of suppression of false recognition, confusion, and so forth of the meanings.

The work indicator light 62*a* is disposed on a counterweight near the rear end radius of the upper swing structure so as to be highly visible from the surroundings in operation.

The warning indicator light 62*b*, the communication indicator light 62*c*, and the operation indicator light 62*d* are disposed on the upper surface of the cab so as to be easily visually recognized from a place remote from the machine body or a place higher than the machine body because the manager who monitors remote maneuvering or automatic operation is a main notification target thereof.

The approach permission indicator light 62*e* and the action request indicator light 62*f* are disposed on the front left side of the cab that is near an opening-closing handlebar of a door of the cab 4 so as to be easily visually recognized from a place close to the machine body and the height of the eye level of the worker because the worker who exists in the surroundings of the machine body, particularly in the vicinity thereof, is a main notification target thereof.

Three state indicator lights 62 of the warning indicator light 62*b*, the communication indicator light 62*c*, and the operation indicator light 62*d* are disposed close to each other, that is, to lie in a row and make one aggregation. Moreover, two state indicator lights 62 of the approach permission indicator light 62*e* and the action request indicator light 62*f* are disposed close to each other, that is, to lie in a row and make one aggregation. Furthermore, the aggregation of the warning indicator light 62*b*, the communication indicator light 62*c*, and the operation indicator light 62*d* and the aggregation of the approach permission indicator light 62*e* and the action request indicator light 62*f* are disposed at a distance. Disposing in this manner can prevent the occurrence of confusion of meanings when the worker who is the notification target of information of each state indicator light 62 visually recognizes the state indicator light 62.

Moreover, for the state indicator light of green indicating "normality" of the operation state of the machine body and the state indicator light of green indicating "permission" of approach to the machine body, in order to prevent the occurrence of confusion of the meanings for the manager of unattended operation and the worker in the surroundings who are the notification targets thereof, the state indicator lights using the same color are disposed at a distance. Furthermore, the state indicator light regarding which the manager of unattended operation is the notification target is disposed on the upper side of the cab and the state indicator light regarding which the worker in the surroundings is the notification target is disposed on the lower side of the cab to cause the state indicator light indicating information required by each notification target to enter the field of view more easily.

Furthermore, by disposing the approach permission indicator light 62*e* and the action request indicator light 62*f* regarding which the worker in the surroundings is the notification target at positions that lie in a row, recognition of what represents the contents of notification for the worker in the surroundings by these two is facilitated.

Moreover, the safety and the work efficiency can be more enhanced by applying the following contrivance.

It is preferable to dispose the operation indicator light 62*d* at a position that is impossible for the operator in riding to visually recognize from the inside of the cab and dispose the approach permission indicator light 62*e* at a position that can be visually recognized by the operator in riding from the inside of the cab and a position that is close to the cab and can be visually recognized from the worker in the surroundings who exists outside the cab.

In this case, only the approach permission indicator light 62*e* in the operation indicator light 62*d* and the approach permission indicator light 62*e*, which are indicator lights of the same green, enters the field of view of the operator who rides in the cab 4. Thus, when the operator rides, easiness of recognizing that the current state is the approach-permitted state (state in which the possibility of approach by the worker in the surroundings is high) can be improved and the safety can be improved.

Furthermore, the operator can check turning-on of the approach permission indicator light 62*e* while riding and therefore can check whether the approach permission indicator light 62*e* is normally operating while existing in the cab.

Moreover, it is preferable to install the approach permission indicator light 62*e* at a position with which the worker in the surroundings who visually recognizes the approach permission indicator light 62*e* enters the field of view of the operator who rides in the cab 4.

When it is defined that approach is permitted only when the approach permission indicator light 62*e* is turned on as a rule of a work site, the worker in the surroundings first attempts to check the turn-on state of the approach permission indicator light 62*e* when approaching the machine body. Thus, if the position at which visual contact with the approach permission indicator light 62*e* can be made is allowed to be included in the field of view of the operator who rides in the cab 4, when the worker in the surroundings approaches the machine body, the worker can quickly enter the field of view of the operator who rides in the cab 4. This can suppress the possibility of approach by the worker from a direction in which visual recognition by the operator who rides in the cab 4 is difficult, such as the rear right side of the machine body, and can improve the safety of the work site.

As described above, by making a contrivance regarding the disposing and the indication color of each state indicator light 62, each of the worker who exists in the surroundings of the machine body and the worker who exists in a place remote from the machine body (managing/monitoring person of the machine body) is allowed to recognize the necessary information without false recognition and the safety and the work efficiency of the workers can be improved.

As illustrated in FIG. 2, the hydraulic excavator 100 includes the machine controller 11 that controls operation of the whole of the machine body, a lock switch 12 that is a lever-type switch for switching operation locking means that switches whether or not operation of the whole of the machine body is possible, and the display device 5 on which various meters and machine body information are displayed to allow the operator to check the status of the hydraulic excavator. The hydraulic excavator 100 includes also a switch box 13 for manually changing the engine speed and operating the display device 5, and a monitor controller 14 that accepts various switch inputs of the switch box 13 and changes the contents of display on the display device 5. The machine controller 11, the lock switch 12, the display device 5, the switch box 13, and the monitor controller 14 are disposed inside the cab 4.

Furthermore, the operation device 15 to execute various operations of the hydraulic excavator is disposed in the cab 4 of the hydraulic excavator 100. For example, the operation device 15 is a plurality of operation levers to execute boom raising operation, boom lowering operation, arm crowding operation, arm dumping operation, bucket crowding operation, bucket dumping operation, left swing operation, right swing operation, right forward travelling operation, right rearward travelling operation, left forward travelling operation, left rearward travelling operation, and so forth.

The hydraulic excavator 100 is equipped with the engine 16 as a prime mover. An engine controller 17 electrically connected to the engine 16 grasps the state of the engine 16 from signals of a temperature sensor and a pickup sensor incorporated in the engine and controls the engine speed and the torque by controlling a valve and so forth.

The machine controller 11, the monitor controller 14, and the engine controller 17 are connected by CAN communication and each execute transmission and reception of necessary information.

For example, regarding engine speed control, the machine controller 11 computes the engine target speed according to a control voltage that is set by an engine control dial and is then output, the operation state of the operation device 15, the load state and a temperature condition of the hydraulic pump 18, and so forth, and transmits the computed engine target speed to the engine controller 17. The engine controller 17 controls the engine 16 to cause the engine speed to become the engine target speed computed by the machine controller 11. In addition, the engine controller 17 computes the engine actual speed from a signal of the pickup sensor incorporated in the engine 16 and transmits the engine actual speed to the machine controller 11. The monitor controller 14 acquires the engine target speed and the engine actual speed that exist on the CAM communication and displays information such as the acquired engine target speed and engine actual speed on the display device 5 as one of state indications of the machine body.

A hydraulic operating fluid delivered from the hydraulic pump 18 of the variable displacement type driven by the engine 16 is supplied to the travelling hydraulic motors 1*a*, the swing hydraulic motor 2*a*, the boom cylinder 3*d*, the arm cylinder 3*e*, and the bucket cylinder 3*f* through a control valve 19 that controls the flow of a pressurized fluid to the respective hydraulic actuators 1*a*, 2*a*, 3*d*, 3*e*, and 3*f*.

In the embodiment, the case in which the one hydraulic pump 18 is included is exemplified. However, the configuration may be made in such a manner that a plurality of hydraulic pumps are mounted in consideration of the situation in which a plurality of actuators are simultaneously operated, or the like.

The operation device 15 is electrical operation levers and outputs a PWM output signal (operation signal) according to the operation amount to the machine controller 11.

A pilot pump 20 that is a hydraulic fluid source is driven by the engine 16 and a delivery pressure from the pilot pump 20 is supplied to a pump regulator 21 and a lock valve 22 that is operation locking means. The delivery pressure from the pilot pump 20 is kept at a pilot primary pressure (for example, 4 MPa) by a pilot relief valve that is not illustrated.

The pump regulator 21 includes a pump flow control solenoid valve that is a solenoid proportional valve for reducing the pilot primary pressure from the pilot pump 20 and using the reduced pressure, and reduces the pilot primary pressure according to a command current output by the machine controller 11 to generate a pump flow control pressure (secondary pressure). Furthermore, the pump regulator 21 includes a control mechanism that controls the tilting (displacement volume) of the hydraulic pump 18, and controls the volume, that is, the delivery flow rate, of the hydraulic pump 18 according to the output of the pump flow control solenoid valve (pump flow control pressure).

The pump regulator 21 executes control in such a manner that, in the characteristic of the hydraulic pump 18, the pump volume becomes the minimum when the pump flow control pressure is the minimum (for example, 0 MPa) and the pump volume becomes the maximum when the pump flow control pressure is the maximum (for example, 4 MPa). The pump flow control solenoid valve is at an interruption position (for example, 0 MPa) in the non-controlled state (for example, 0 mA) and is controlled in such a manner that the pump flow control pressure increases as the command current from the machine controller 11 increases.

The pump regulator 21 is provided with a pump flow control pressure sensor 23 for sensing the pump flow control pressure. The pump flow control pressure sensed by the pump flow control pressure sensor 23 is input to the machine controller 11 as a sensing signal. The machine controller 11 estimates the pump volume on the basis of the pump flow control pressure sensed by the pump flow control pressure sensor 23 by using the relation between the pump flow control pressure retained in advance and the pump volume, and computes the delivery flow rate of the hydraulic pump 18 by multiplying the estimated pump volume and the engine speed.

The lock valve 22 is the operation locking means that switches whether or not operation of the whole of the machine body is possible. The lock valve 22 is switched to an interruption position and a communication position by a solenoid driven by the machine controller 11.

The lock switch 12 is in an OFF (opened between terminals) state when a lock lever (not illustrated) installed in the cab 4 is at a lock position. The machine controller 11 monitors the state of the lock switch 12 and switches the lock valve 22 to the interruption position in a non-excited state when the lock switch 12 is OFF.

Furthermore, the lock switch 12 is in an ON (conductive between terminals) state when the lock lever is at a lock release position. The machine controller 11 monitors the state of the lock switch 12 and switches the lock valve 22 to the communication position in an excited state by applying a control voltage (for example, 24 V) to the lock valve 22 when the lock switch 12 is ON.

A pilot pressure control reducing valve 24 is disposed in a pilot circuit between the lock valve 22 and the control valve 19. The machine controller 11 drives the pilot pressure control reducing valve 24 according to the magnitude of a lever operation amount that is an input signal of the operation device 15.

When the lock valve 22 is at the communication position, the pilot primary pressure is supplied to the pilot pressure control reducing valve 24 and a pilot operation pressure is generated by the pilot pressure control reducing valve 24. Thereupon, the generated pilot operation pressure moves a plurality of spools (directional control valves) that exist in the control valve 19 to thereby adjust the flow of the hydraulic operating fluid delivered from the hydraulic pump 18. This enables operation of the corresponding hydraulic actuator 1*a*, 2*a*, 3*d*, 3*e*, or 3*f*.

When the lock valve 22 is at the interruption position, the pilot primary pressure is not supplied to the pilot pressure control reducing valve 24. Therefore, the pilot operation pressure also ceases to be generated (for example, becomes 0 MPa) and operation of the hydraulic actuators 1*a*, 2*a*, 3*d*, 3*e*, and 3*f* becomes impossible.

That is, whether or not operation of the whole of the machine body is possible is switched according to the position of the lock lever (not illustrated) installed in the cab 4. Specifically, operation of the whole of the machine body is inhibited when the lock lever is at the lock position, and operation of the machine body is permitted when the lock lever is at the release position.

An operation pressure sensor 25 for sensing the pilot operation pressure is disposed in the pilot circuit between the pilot pressure control reducing valve 24 and the control valve 19.

The sensing signal of the operation pressure sensor 25 is input to the machine controller 11. The machine controller 11 can grasp the operation status of the hydraulic excavator 100 and whether or not the pilot pressure control reducing valve 24 is normally operating, on the basis of the pilot operation pressure sensed by the operation pressure sensor 25.

A pump delivery pressure sensor 26 for sensing the pump delivery pressure is disposed in a delivery circuit between the hydraulic pump 18 and the control valve 19. The machine controller 11 can grasp the pump load of the hydraulic pump 18 of the hydraulic excavator 100 on the basis of the pump delivery pressure sensed by the pump delivery pressure sensor 26.

The machine controller 11 calculates the pump target flow rate based on operation according to the engine speed and input of the operation device 15. Moreover, the machine controller 11 computes the limited horsepower according to the engine speed, the operation status, and other machine body states (temperature and so forth) and calculates the pump upper-limit flow rate based on horsepower limitation from the input of the pump delivery pressure sensor 26 and the limited horsepower. The machine controller 11 selects, as the pump target flow rate, the lower one of the pump target flow rate based on operation and the pump upper-limit flow rate based on horsepower limitation, and drives the pump flow control solenoid valve to cause the delivery flow rate of the hydraulic pump 18 to become the pump target flow rate.

The communication terminal 61 receives a command signal for executing unattended operation such as remote maneuvering or automatic operation from the external of the machine body, and transmits the posture of the machine body and various kinds of state information to the external.

The communication terminal 61 is connected to the external operation controller 60 by the CAN communication. Furthermore, the external operation controller 60 and the machine controller 11 are also connected by the CAN communication. At the time of unattended operation (remote operation, automatic operation) of the hydraulic excavator 100, the external operation controller 60 passes an operation command received from the external through the communication terminal 61 to the machine controller 11 to execute actuator operation and actuation of pumps, valves, and so forth in the unattended operation.

Moreover, the external operation controller 60 can grasp the state of various switches and various sensors connected to the machine controller 11 by the CAN communication that links the external operation controller 60 and the machine controller 11.

Furthermore, the communication terminal 61 is connected also to the machine controller 11 by the CAN communication besides the external operation controller 60 and can transmit various kinds of state information (temperature, engine speed, posture information, and so forth) of the machine body received from the machine controller 11 to a remote operation device or control room via a network.

Moreover, the communication terminal 61 can send a command also to the monitor controller 14 via the machine controller 11 and a monitor (display device 5) can be caused to display a specific message, icon, and so forth by a command from a remote place.

Furthermore, the communication terminal 61 is connected to a plurality of cameras 63 mounted on the machine by Ethernet communication and the communication terminal transmits a video signal thereof via a network. This makes it possible to check video of the surroundings of the machine body even from a remote place.

Six kinds of rotating lights, the work indicator light 62*a*, the warning indicator light 62*b*, the communication indicator light 62*c*, the operation indicator light 62*d*, the approach permission indicator light 62*e*, and the action request indicator light 62*f*, are electrically connected to the external operation controller 60 as state indicator lights for notifying the surroundings of the state of the machine body, and turning-on (ON) and turning-off (OFF) are switched by a command of the external operation controller 60.

Moreover, an external speaker 66 for notifying the worker in the surroundings of a voice message or warning sound relating to unattended operation is connected to the external operation controller 60, and outputs a notification sound by a command from the external operation controller 60.

An operation state changeover switch 64 for executing switching between attended operation and unattended operation is mounted in the cab 4 of the hydraulic excavator 100 and is electrically connected to the machine controller 11. The operation state changeover switch 64 is a so-called momentary-type switch and the machine controller 11 can discriminate whether the operation state changeover switch 64 is in a pressed state (ON) or in a non-pressed state (OFF).

Furthermore, a turn-on condition changeover switch 65 for changing (switching) the turn-on condition of the state indicator lights 62 by the operator who rides is mounted in the cab 4 of the hydraulic excavator 100, and is electrically connected to the machine controller 11. The turn-on condition changeover switch 65 is a so-called momentary-type switch, and the machine controller 11 can discriminate whether the turn-on condition changeover switch 65 is in a pressed state (ON) or in a non-pressed state (OFF).

Here, although not illustrated, each of the machine controller 11, the monitor controller 14, the engine controller 17, and the external operation controller 60 is configured by a central processing unit (CPU), a memory, and an interface, executes a program saved in the memory in advance by the central processing unit (CPU), executes processing by the central processing unit (CPU) on the basis of set values saved in the memory and signals input from the interface, and outputs signals from the interface.

Figure 4:
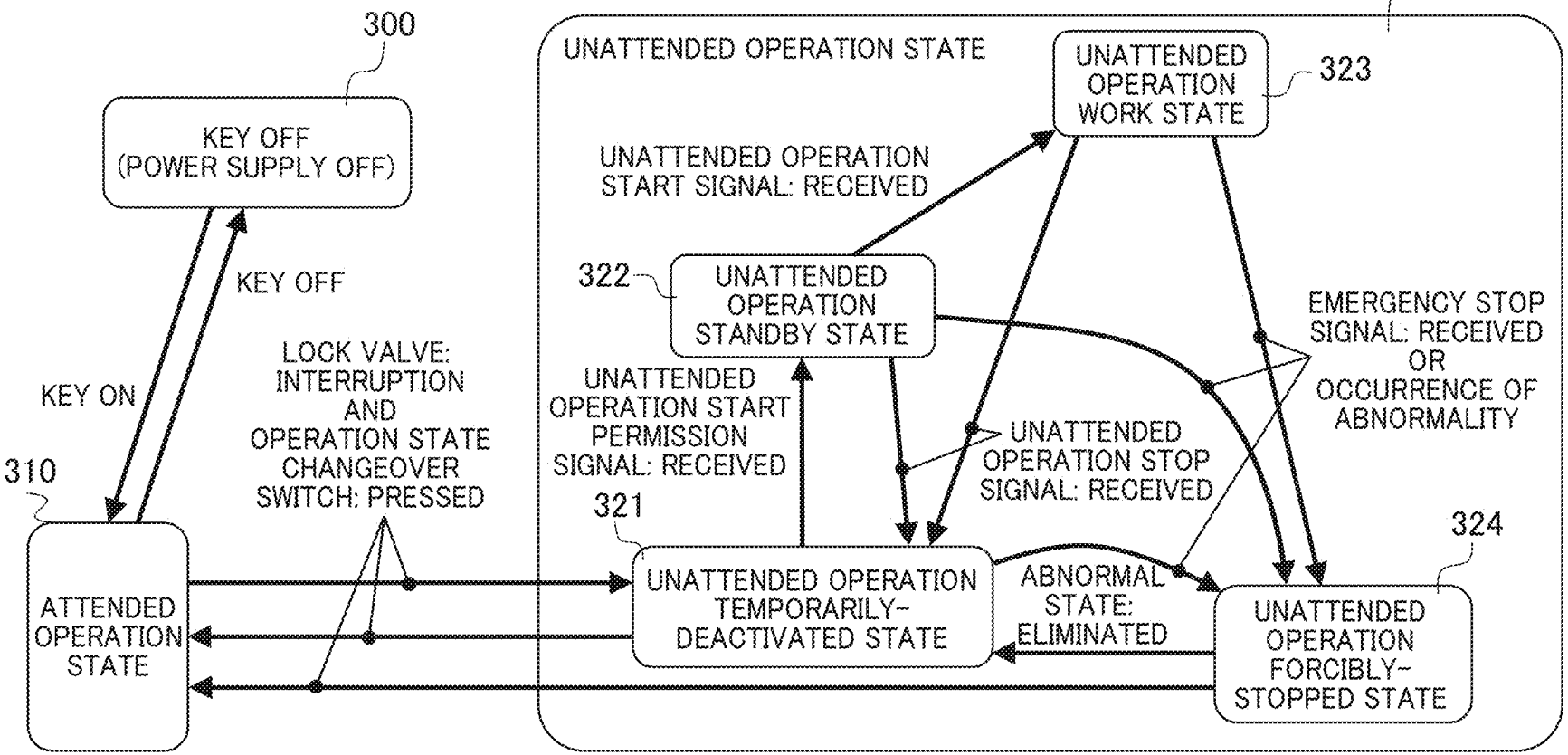
FIG. 4 is a diagram illustrating state transition of a control state of a machine body in the hydraulic excavator.

FIG. 4 is a diagram illustrating state transition of the control state of the machine body in the hydraulic excavator. Moreover, FIG. 5 is a diagram illustrating the relation between the possibility of machine body operation by the operator who rides and the possibility of machine body operation by a remote (external) command, in each control state illustrated in FIG. 4. In FIG. 5, the relation among a control state 211, possibility 212 of the machine body operation by the operator who rides, and possibility 213 of the machine body operation by the remote (external) command is illustrated in a table format regarding each control state.

Here, the machine body operation is all operations other than ON/OFF operation of a starting key of the hydraulic excavator 100 and operation equivalent to pressing-down operation of the operation state changeover switch 64 and includes, for example, operations such as start and stop of the engine 16, interruption and release of the lock valve 22, operation of the hydraulic actuators 1*a*, 2*a*, 3*d*, 3*e*, and 3*f*, operation of other pieces of electrical equipment, and setting change of the machine body.

When key ON operation is executed through operation by the operator who rides in the cab 4 in a key OFF (power supply OFF) state 300 of the hydraulic excavator 100, the machine controller 11 and the external operation controller 60 make a transition to an attended operation state 310.

The attended operation state 310 is a state in which the hydraulic excavator 100 is operated by manual operation. As illustrated in FIG. 5, in the attended operation state 310, the machine body operation is possible by the operator who rides in the cab 4, whereas the machine body operation by the remote (external) command is impossible.

If the operator who rides in the cab 4 presses down the operation state changeover switch 64 when the lock valve 22 is in the interruption state in the attended operation state 310, the machine controller 11 and the external operation controller 60 make a transition to an unattended operation temporarily-deactivated state 321 that is one of unattended operation states 320.

Furthermore, if the operator who rides in the cab 4 presses down the operation state changeover switch 64 when the lock valve 22 is in the interruption state in the unattended operation temporarily-deactivated state 321 of the unattended operation states 320, the machine controller 11 and the external operation controller 60 make a transition to the attended operation state 310.

Here, the purpose of including the interruption state of the lock valve 22 in the condition of the state transition between the attended operation state 310 and the unattended operation state 320 is to execute switching of the control state between attended operation and unattended operation in the state in which the machine body is stopped (that is, state in which the hydraulic actuators 1*a*, 2*a*, 3*d*, 3*e*, and 3*f* are not acting) inevitably and prevent the machine body from suddenly moving unintentionally in the switching of the control state.

Here, in the present embodiment, at a work site at which a construction machine (hydraulic excavator 100) capable of unattended operation operates, all workers possess a communication terminal capable of network connection (worker communication terminal: for example, wristwatch-type wearable terminal), and the worker communication terminals, the construction machine (hydraulic excavator 100), and a control room that manages and monitors the unattended operation are connected to the same network, and data transfer by mutual communication is possible in each piece of equipment.

As illustrated in FIG. 5, in the unattended operation temporarily-deactivated state 321, the machine body operation is possible by the operator who rides in the cab 4, whereas the machine body operation by the remote (external) command is impossible.

In the unattended operation temporarily-deactivated state 321, the operator who rides in the cab 4 (worker who has pressed down the operation state changeover switch 64) moves to the outside of the work range of the machine body, thereafter checks the safety of the surroundings of the machine body, and operates the worker communication terminal to transmit an unattended operation start permission signal to the machine body and the control room. When the hydraulic excavator 100 receives the unattended operation start permission signal in the unattended operation temporarily-deactivated state 321, the machine controller 11 and the external operation controller 60 make a transition to an unattended operation standby state 322.

The unattended operation standby state 322 is a state in which remote operation can be started at any time depending on determination by the control room side. As illustrated in FIG. 5, in the unattended operation standby state 322, the machine body operation by the operator who rides in the cab 4 (operation of levers and switches in the cab 4) is turned impossible. Moreover, the machine body operation by the remote (external) command is impossible.

In the case of canceling the unattended operation state 320 and making a return to the attended operation state 310 in the unattended operation standby state 322, an unattended operation stop signal is transmitted from the worker communication terminal or the control room to the hydraulic excavator 100. When the hydraulic excavator 100 receives the unattended operation stop signal at the time of the unattended operation standby state 322, the machine controller 11 and the external operation controller 60 make a transition to the unattended operation temporarily-deactivated state 321. Thus, through pressing-down of the operation state changeover switch 64 by the operator who rides in the cab 4 when the lock valve 22 is in the interruption state, a transition of the machine controller 11 and the external operation controller 60 to the attended operation state 310 can be made.

When the control room transmits an unattended operation start signal to the hydraulic excavator 100 and the hydraulic excavator 100 receives the unattended operation start signal in the unattended operation standby state 322, the machine controller 11 and the external operation controller 60 make a transition to an unattended operation work state 323.

As illustrated in FIG. 5, in the unattended operation work state 323, the machine body operation by the operator who rides in the cab 4 (operation of levers and switches in the cab) is impossible, and all operations are possibly only by the remote (external) command.

As above, in the present embodiment, the setting is made to cause a transition from the unattended operation temporarily-deactivated state 321 to the unattended operation work state 323 through the unattended operation standby state 322. That is, the setting is made in such a manner that confirmation of intension of both the worker in the surroundings of the machine body and the control room, commencing with the transmission of the unattended operation start permission signal by the worker communication terminal, is required to make a transition to the unattended operation work state 323, in which the machine body operation by the remote (external) command is possible. By defining the procedure of the state transition as above, the occurrence of unattended operation work (operation of the machine body) at a timing that is not intended by the worker in the surroundings or a timing at which safety check of the surrounding has not been completed can be prevented and the safety can be improved.

In the case of temporarily executing the machine body operation by the operator who rides in the cab 4 or making a return to the attended operation state 310 in work in the unattended operation work state 323, the control room transmits the unattended operation stop signal to the hydraulic excavator 100, and the hydraulic excavator 100 receives the unattended operation stop signal. Thereupon, the machine controller 11 and the external operation controller 60 make a transition to the unattended operation temporarily-deactivated state 321.

It is desirable that transmission of the unattended operation stop signal from the worker communication terminal in the unattended operation work state 323 is made impossible (or, in the machine controller 11 and the external operation controller 60 on the machine body side, acceptance of the unattended operation stop signal from the worker communication terminal is prevented in the unattended operation work state 323). Due to this, unattended operation is not carelessly stopped in work by the unattended operation, and the work efficiency of the unattended operation can be improved.

When the worker in the surroundings requests a temporary stop of unattended operation in the unattended operation work state 323, the worker operates the worker communication terminal to transmit an unattended operation stop request to the control room. The managing/monitoring person who exists in the control room that has received the unattended operation stop request causes the machine body to operate until an appropriate suspension point of work, adjusts the posture of the machine body to proper posture for stop, and thereafter transmits the unattended operation stop signal to the machine body, and the machine body that has received the unattended operation stop signal makes a transition to the unattended operation temporarily-deactivated state 321. This can normally stop the unattended operation. Therefore, management of the work process of the unattended operation and safe work stop can be executed, and the safety and the work efficiency of the work site can be improved.

When the machine body receives an emergency stop signal issued through pressing-down of an emergency stop switch (not illustrated) or transmitted via a network in the unattended operation temporarily-deactivated state 321, the unattended operation standby state 322, or the unattended operation work state 323, the machine controller 11 and the external operation controller 60 make a transition to an unattended operation forcibly-stopped state 324. A transition to the unattended operation forcibly-stopped state 324 is made similarly also when the machine controller 11 or the external operation controller 60 determines that an abnormality that poses an obstacle to continuation of unattended operation has occurred in the unattended operation temporarily-deactivated state 321, the unattended operation standby state 322, or the unattended operation work state 323.

It is preferable to set the behavior of the machine body in the unattended operation forcibly-stopped state 324 according to the degree of the event that has occurred.

For example, it is conceivable that the engine 16 is automatically stopped when it is determined that continuing operation of the engine 16 causes a risky situation. Furthermore, when the event is at such a degree that the front posture has gotten out of the normal range, it suffices to only stop operation of the hydraulic actuators 1*a*, 2*a*, 3*d*, 3*e*, and 3*f*.

Regarding the way to stop the hydraulic actuators 1*a*, 2*a*, 3*d*, 3*e*, and 3*f*, for example, it is conceivable that the hydraulic actuators 1*a*, 2*a*, 3*d*, 3*e*, and 3*f* are immediately stopped in such a case where the emergency stop switch is pressed. Moreover, when the event is at such a degree that network connection is interrupted, by gently stopping the hydraulic actuators 1*a*, 2*a*, 3*d*, 3*e*, and 3*f* by control on the machine body side, the influence attributed to large sway of the machine body or a load due to sudden stop can be made small and the safety can be enhanced.

Furthermore, regarding the lock valve 22, if it is allowed to be automatically switched to the locking state when the machine body is stopped, erroneous operation of movement of the machine body due to unintentional touch with a lever by the worker can be prevented when the worker rides thereafter.

As illustrated in FIG. 5, in the unattended operation forcibly-stopped state 324, because of the state in which unattended operation is stopped, the machine body operation is possible only by the operator who rides in the cab 4 (levers and switches in the cab 4).

If the operator who rides in the cab 4 presses down the operation state changeover switch 64 when the lock valve 22 is in the interruption state in the unattended operation forcibly-stopped state 324, the machine controller 11 and the external operation controller 60 make a transition to the attended operation state 310. Due to this, for example, even when a problem has occurred in network connection and unattended operation has become impossible, the worker can ride in the cab 4 of the hydraulic excavator 100 and cause the machine body to evacuate.

Moreover, when the machine controller 11 or the external operation controller 60 determines that the abnormal state has been eliminated in the unattended operation forcibly-stopped state 324, a transition to the unattended operation temporarily-deactivated state 321 is automatically made.

Subsequently, control of the state indicator lights by the external operation controller will be described.

Figure 6:
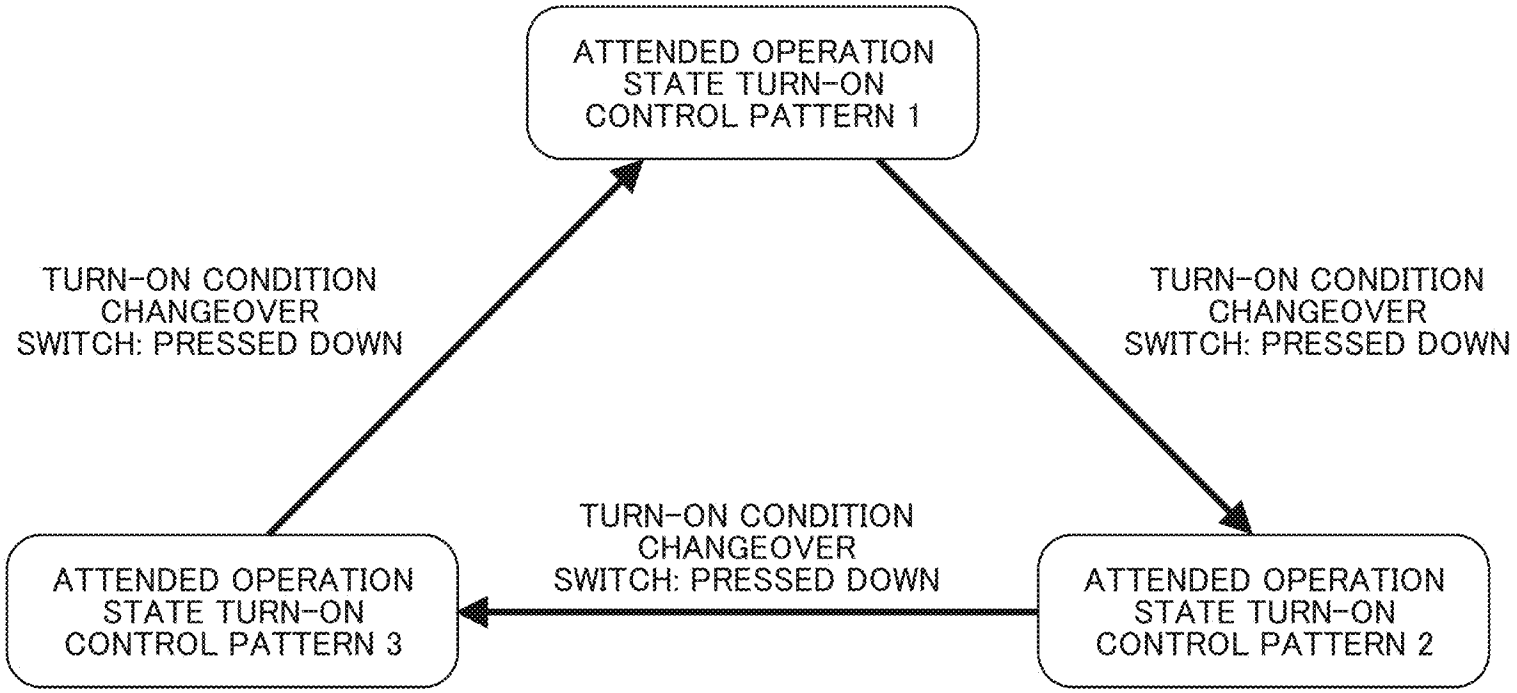
FIG. 6 is a diagram illustrating the manner of switching of control patterns of the state indicator lights in an attended operation state.

FIG. 6 is a diagram illustrating the manner of switching of control patterns of the state indicator lights in the attended operation state. FIG. 7 to FIG. 9 are diagrams illustrating control tables in the respective control patterns. Furthermore, FIG. 10 is a diagram illustrating a control table in the unattended operation state.

In the control tables illustrated in FIG. 7 to FIG. 10, the relation among a name 221 of the state indicator light, an indication color 222, and a turn-on condition (state of the machine body when the light is turned on) 223 is set regarding each state indicator light (specifically, each of names 221*a* to 221*f* of the state indicator lights) and is stored in the external operation controller 60.

The external operation controller 60 is what controls turning-on and turning-off of the state indicator lights 62. Turn-on control of the state indicator lights 62 is switched between at the time of the attended operation state 310 and at the time of the unattended operation state 320 in a rough classification. Moreover, the turn-on control at the time of the attended operation state 310 is switched among "turn-on control pattern 1" to "turn-on control pattern 3" every time the turn-on condition changeover switch 65 is pressed.

First, the turn-on control at the time of the attended operation state 310 will be described.

The external operation controller 60 retains three kinds of control tables of "turn-on control pattern 1" (see FIG. 7), "turn-on control pattern 2" (see FIG. 8), and "turn-on control pattern 3" (see FIG. 9) as turn-on control patterns of the state indicator lights 62 in the attended operation state 310. The control pattern is switched in order of "turn-on control pattern 1," "turn-on control pattern 2," "turn-on control pattern 3," and "turn-on control pattern 1" every time the operator who rides in the cab 4 presses down the turn-on condition changeover switch 65. The external operation controller 60 stores the turn-on control pattern selected at the time of key OFF and, at the time of next key ON, reads out and uses the turn-on control pattern at the time of the end of the previous operation.

As illustrated in FIG. 7, in "turn-on control pattern 1" of the attended operation state 310, the work indicator light 62*a* is turned on when the engine is operating. This is to notify the surroundings that the hydraulic excavator 100 is in operation.

The approach permission indicator light 62*e* is turned on when the engine is stopped or the lock valve 22 is at the interruption position. That is, it is turned on when the state in which the machine body does not start to move is ensured.

This allows the worker in the surroundings to visually check whether the operator who rides in the cab 4 has surely set the machine body to the stopped state when the worker in the surroundings needs to inevitably approach the machine body, and the safety of the work site improves.

The warning indicator light 62*b*, the communication indicator light 62*c*, the operation indicator light 62*d*, and the action request indicator light 62*f* are always turned off because they are the state indicator lights 62 for notifying about information relating to the unattended operation state 320.

Due to this, information unnecessary for the worker in the surroundings is not notified. This can enhance the visibility of whether approach is permitted, which is truly necessary information. In addition, for the worker who manages or monitors unattended operation, it is also possible to determine that the control state is not the unattended operation state 320 (that the control state is the state in which the external command is not accepted) by confirming that these state indicator lights 62 that notify about the state of the unattended operation are turned off.

As illustrated in FIG. 8, in "turn-on control pattern 2" of the attended operation state 310, the work indicator light 62*a* is turned on when the engine 16 is operating similarly to "turn-on control pattern 1." However, the other state indicator lights are always turned off. That is, the same turn-on pattern as a hydraulic excavator having only the attended operation state is made.

When notification indicating permission of approach can be made as in "turn-on control pattern 1," the safety can be improved for the worker in the surroundings. However, because the approach permission indicator light 62*e* is installed at a place that enters the field of view of the operator who rides in the cab 4, it is conceivable that the operator feels continuation of turning-on of the approach permission indicator light 62*e* to be annoying during engine stop or during lock valve interruption, such as during suspension of work.

In such a case, operation is executed in such a manner that notification of permission of approach to the worker in the surroundings is made the same as conventional notification (what is based on gesture, voice, or sound), and priority is given to the work efficiency of the operator who rides in the cab 4 and selection of the pattern in which the approach permission indicator light 62*e* can be always turned off (that is, "turn-on control pattern 2") is allowed.

As illustrated in FIG. 9, "turn-on control pattern 3" of the attended operation state 310 is different from "turn-on control pattern 1" in that not the approach permission indicator light 62*e* but the operation indicator light 62*d* is employed as the state indicator light 62 turned on when the engine is stopped or when the lock valve 22 is at the interruption position, that is, the state in which the machine body does not start to move is ensured.

This can eliminate the point of concern in "turn-on control pattern 1," that is, the annoyance due to the entry of the turned-on state indicator light 62 into the field of view of the operator who rides in the cab 4 at the time of attended operation. In the unattended operation state 320, when the operation indicator light 62*d* is turned on, the communication indicator light 62*c* is also turned on inevitably. Thus, for the worker who manages or monitors unattended operation, it is also possible to determine that the control state is not the unattended operation state 320 (that is, that the control state is the state in which the external command is not accepted) although the operation indicator light 62*d* is turned on, by confirming that the communication indicator light 62*c* is turned off.

Next, the turn-on control at the time of the unattended operation state 320 will be described. The external operation controller 60 retains the control table in which the turn-on control pattern of the state indicator lights 62 in the unattended operation state 320 (see FIG. 10) is defined.

As illustrated in FIG. 10, in the unattended operation state 320, the work indicator light 62*a* is turned on when the engine is operating.

The warning indicator light 62*b* is turned on when the control state is the unattended operation forcibly-stopped state 324. That the current state is an abnormal state in which it is impossible to continue the unattended operation is notified to the managing/monitoring person by the indicator light of red.

The communication indicator light 62*c* is turned on when the control state is any of the unattended operation temporarily-deactivated state 321, the unattended operation standby state 322, the unattended operation work state 323, and the unattended operation forcibly-stopped state 324 (that is, when the control state is not the attended operation state) and network connection between the machine body and the control room is normal. At the time of actual work, the communication indicator light 62*c* is turned off in the attended operation state 310. Thus, when the operator who rides in the cab 4 presses the operation state changeover switch 64 and a transition to the unattended operation temporarily-deactivated state 321 is made, the communication indicator light 62*c* is switched from the turned-off state to the turned-on state if the network connection is normal. The worker can recognize that the current state is the state in which the machine body executes unattended operation through confirming that this communication indicator light 62*c* is turned on and the warning indicator light 62*b* is turned off.

The operation indicator light 62*d* is turned on when the control state is the unattended operation work state 323. When the operation indicator light 62*d* is turned on, the machine body operation by the operator who rides in the cab 4 is impossible, and the machine body operation by the remote (external) command is possible.

The approach permission indicator light 62*e* is turned on when the control state is any of the unattended operation temporarily-deactivated state 321, the unattended operation standby state 322, and the unattended operation forcibly-stopped state 324 (that is, when the control state is not the unattended operation work state 323 in the unattended operation states 320) and when the engine is stopped or the lock valve 22 is in the interruption state (that is, the state in which the machine body does not start to move is ensured). Even when the engine is stopped or the lock valve 22 is in interruption, the approach permission indicator light 62*e* is not turned on (turned off) if the control state is the unattended operation work state 323. This is what is defined in consideration of the possibility that, even if the lock valve 22 is in interruption, the lock valve 22 is switched to the release state by the remote (external) command and the machine body starts to move in the case of the unattended operation work state 323. The safety is further improved by notifying the worker in the surroundings of permission of approach only when the state in which the remote (external) command is not accepted is surely made.

The action request indicator light 62*f* is turned on when an abnormal state in which the worker is requested to ride in the cab and make specific action has occurred in the machine body in the unattended operation state 320 (this is one of conditions of transition to the unattended operation forcibly-stopped state 324) or when the machine body has received a turn-on signal of the action request indicator light 62*f*. Here, suppose that the turn-on signal of the action request indicator light 62*f* is transmitted through a network from the control room that manages and monitors unattended operation.

For example, when the network connection between the machine body and the control room is disconnected in execution of remote maneuvering work in an unattended operation work state 320 (that is, in the case of the unattended operation work state 323), the operation state makes a transition from the unattended operation work state 323 of the unattended operation state 320 to the unattended operation forcibly-stopped state 324, and the external operation controller 60 stops operation of the hydraulic actuators 1*a*, 2*a*, 3*d*, 3*e*, and 3*f* and causes interruption of the lock valve 22. The machine body that has become this state (unattended operation forcibly-stopped state 324) is in the state in which the machine body operation by the remote (external) command is impossible. However, leaving the machine body that has become the abnormal state alone for a long time poses an obstacle to work. Thus, in order to execute recovery work, the posture of the machine body needs to be changed or the machine body needs to be moved to a safe place or a specific evacuation place. However, it is imagined that a long time is taken when the managing/monitoring person goes toward the machine body from the control room existing at a place remote from the machine body or the worker who checks information at the control room side becomes absent and the efficiency of the recovery work lowers when the number of managing/monitoring persons is one.

In such a case, by sharing in advance something to the effect that "riding in the cab 4 of the machine body and cooperating with recovery work when the action request indicator light 62*f* is turned on" as an operation rule of the work site as a premise, asking a worker who exists near the machine body for cooperation is enabled through turning on the action request indicator light 62*f* when the control state has become the unattended operation forcibly-stopped state 324.

Moreover, it becomes possible to smoothly execute recovery work if display is allowed to be made on the monitor (display device 5) in the cab 4 regarding contact information (phone number) of the control room or the managing/monitoring person and operation or action for which the worker who rides is asked when the action request indicator light 62*f* is turned on.

As another scene, for example, even when the machine body is normally in operation in the unattended operation work state, it is also possible to transmit the action request indicator light turn-on signal simultaneously with transmitting the unattended operation stop signal from the control room to the machine body in the case of desiring to have the worker check the situation of the surroundings of the machine body by direct visual contact. Also in this case, by having the worker in the surroundings ride in the cab and asking the worker for cooperation, the stop time of the machine body can be shortened and the work efficiency as the whole of the work site can be improved.

Furthermore, if voice guidance is output from the external speaker 66 connected to the external operation controller 60 when this action request indicator light 62*f* is turned on, causing the worker in the surroundings to notice the state of the machine body more easily can also be implemented.

Moreover, the work efficiency can be further improved by executing the following operation regarding turning-off of the action request indicator light 62*f*. For example, suppose that, in the case of having the worker ride in the hydraulic excavator 100 and execute a recovery response when the action request indicator light 62*f* is turned on, the external operation controller 60 or the remote control room is monitoring the state of the machine body at the time (for example, information on an abnormal state, the posture of the machine body, and so forth). At this time, when the external operation controller 60 or the control room determines that the turn-off condition including the completion of the work in which the worker is caused to ride and respond (for example, elimination of the abnormal state or change to specified machine body posture) is satisfied, the external operation controller 60 turns off the action request indicator light 62*f*.

Making the configuration as above allows the worker who has seen the turning-on of the action request indicator light 62*f* and ridden in the hydraulic excavator 100 to get to more clearly know the completion of the action that the worker oneself is requested to make. Thus, determination of the work completion can be made early and accurately, and the work efficiency as the work site can be further improved.

At this time, the work can be executed earlier and more accurately if the worker who rides in the hydraulic excavator 100 and the managing/monitoring person of the machine body mutually transmit information by a talk or the like through the worker communication terminal, the communication terminal 61 in the cab 4, or the like.

Effects of the present embodiment configured as above will be described.

When the work machine executes unattended operation (remote operation, automatic operation), it is conceivable that there arise a need for the worker in the surroundings of the construction machine to inevitably approach the machine body in the unattended operation and a need to cause work by the construction machine to be suspended.

At this time, for example, even in the case in which it is possible for the worker in the surroundings to forcibly stop the construction machine in the unattended operation (remote operation, automatic operation), if actually the unattended operation is stopped, the work by the unattended operation is unintentionally suspended or stopped and unnecessary lowering of the work efficiency is caused.

Even in the case of causing the manager who remotely manages the unattended operation (remote operation, automatic operation) of the construction machine to temporarily suspend the unattended operation by some kind of means of communication, if that the machine body is in the state in which it does not start to move is not conveyed to the worker in the surrounding, the worker in the surroundings cannot confirm the safety and thus cannot approach the work machine, so that the lowering of the work efficiency is caused. Moreover, it is also conceivable that, even in the case in which the unattended operation is not suspended, the worker in the surroundings falsely recognizes suspension of the unattended operation from the state in which the work machine is not moving and carelessly approaches the construction machine.

Furthermore, when the work machine executes unattended operation (remote operation, automatic operation), the manager who monitors the unattended operation needs to grasp the operation state of the work machine in order to execute safety management and work management. The construction machine that executes the unattended operation is connected to a controller operated by the manager by network communication, and the manager can grasp the state of the machine body by a monitor or the like in the control room if the network connection is normal. However, it becomes impossible to check the operation state of the work machine by the monitor or the like when the network communication is interrupted.

In contrast, in the present embodiment, the hydraulic excavator 100 that executes work at a construction work site includes the machine controller 11 that controls operation of the hydraulic excavator 100, the external operation controller 60 that executes control of unattended operation that does not require operation through riding of the operator in the cab 4 by generating a control signal according to an operation signal received from the external through the communication terminal 61 and sending out the control signal to the machine controller 11, the operation indicator light 62*d* that indicates that the unattended operation of the hydraulic excavator 100 is normally operating, and the approach permission indicator light 62*e* that indicates permission of approach of the worker to the hydraulic excavator 100. The external operation controller 60 is configured to, according to information collected into the machine controller 11, execute control to turn on the operation indicator light 62*d* when determining that the hydraulic excavator 100 is normally operating, and execute control to turn on the approach permission indicator light 62*e* when determining that approach of the worker to the hydraulic excavator 100 is permissible. Therefore, the operation state of the machine body can be simply notified to the worker in the surroundings and the manager, and both the safety and the work efficiency of the worker in the surroundings of the machine body and the manager can be ensured.

<Supplementary Notes>

The present invention is not limited to the above-described embodiment and combinations of various modification examples and embodiments in such a range as not to depart from the gist thereof are included. Furthermore, the present invention is not limited to what includes all configurations explained in the above-described embodiment and what are obtained by changing or deleting part of the configurations are also included.

For example, in the above-described embodiment, description has been made by exemplifying the case in which the information assigned to each of the information indicator lights 62 is conveyed to the worker in the surroundings of the hydraulic excavator 100 or the managing/monitoring person who exists in the control room by turning on the state indicator lights 62. However, the configuration is not limited thereto, and may be made in such a manner that information is conveyed by blinking the state indicator lights 62, for example.

Moreover, the above-described respective configurations, functions, and so forth may be implemented through designing part or all of them by, for example, an integrated circuit. Furthermore, the above-described respective configurations, functions, and so forth may be implemented by software through interpretation and execution of a program that implements the respective functions by a processor.

DESCRIPTION OF REFERENCE CHARACTERS

1: Lower track structure
1*a*: Travelling hydraulic motor
1*b*: Crawler
2: Upper swing structure
2*a*: Swing hydraulic motor
3: Front work implement
3*a*: Boom
3*b*: Arm
3*c*: Bucket
3*d*: Boom cylinder
3*e*: Arm cylinder
3*f*: Bucket cylinder
4: Cab
5: Display device
6 to 8: Angle sensor
9: Inclination sensor
10: Swing angle sensor
11: Machine controller
12: Lock switch
13: Switch box
14: Monitor controller
15: Operation device
16: Engine
17: Engine controller
18: Hydraulic pump
19: Control valve
20: Pilot pump
21: Pump regulator
22: Lock valve
23: Pump flow control pressure sensor
24: Pilot pressure control reducing valve
25: Operation pressure sensor
26: Pump delivery pressure sensor
60: External operation controller
61: Communication terminal
62: State indicator light
62*a*: Work indicator light
62*b*: Warning indicator light
62*c*: Communication indicator light
62*d*: Operation indicator light
62*e*: Approach permission indicator light
62*f*: Action request indicator light
63: Camera
64: Operation state changeover switch
65: Turn-on condition changeover switch
66: External speaker
100: Hydraulic excavator
221*a* to 221*f*: Name of a state indicator light
222: Indication color
223: Turn-on condition
300: State
310: Attended operation state
320: Unattended operation state
321: Unattended operation temporarily-deactivated state
322: Unattended operation standby state
323: Unattended operation work state
324: Unattended operation forcibly-stopped state

The invention claimed is:

1. A construction machine that has an engine and executes work at a construction work site, the construction machine comprising:

a machine controller that controls operation of the construction machine;

an external operation controller that executes control of unattended operation that does not require operation through riding of an operator in a cab, by generating a control signal according to an operation signal received from external through a communication terminal and sending out the control signal to the machine controller;

an operation indicator light that indicates that the unattended operation of the construction machine is normally in operation; and an approach permission indicator light that indicates permission of approach of a worker to the construction machine, wherein the external operation controller is configured to, according to information collected into the machine controller, execute control to turn on the operation indicator light when determining that the construction machine is normally operating, and execute control to turn on the approach permission indicator light when the control state of the construction machine is either an unattended operation standby state in which operation by the operator who rides in the cab or operation by the operation signal received from external by the construction machine is impossible or an unattended operation forcibly-stopped state in which the construction machine has received an emergency stop signal from the external, and when the engine is stopped or the lock valve that switches whether or not operation of the construction machine is at the interruption position.

2. The construction machine according to claim 1, wherein the operation indicator light and the approach permission indicator light are each disposed at a different position.

3. The construction machine according to claim 2, wherein indication colors of the operation indicator light and the approach permission indicator light are a same color.

4. The construction machine according to claim 2, wherein the operation indicator light is disposed on an upper side of the cab in which the operator rides, and the approach permission indicator light is disposed on a lower side of the cab.

5. The construction machine according to claim 2, wherein the operation indicator light is disposed on an upper part of a machine body of the construction machine, and the approach permission indicator light is disposed on the machine body on a lower side relative to the operation indicator light.

6. The construction machine according to claim 2, wherein the operation indicator light is disposed at a position incapable of being visually recognized from the operator who rides in the cab, and the approach permission indicator light is installed at a position allowed to be visually recognized from the operator who rides in the cab and a position allowed to be visually recognized from a worker in surroundings of the cab.

7. The construction machine according to claim 1, wherein the construction machine includes a turn-on condition changeover switch that is disposed in the cab and switches a condition of turning-on of the approach permission indicator light by the external operation controller, and the external operation controller is configured to always turn off the approach permission indicator light when the information collected into the machine controller is information about attended operation in which the operator rides in the cab and executes operation of the construction machine and is information resulting from operation of the turn-on condition changeover switch.

8. The construction machine according to claim 1, wherein the construction machine includes a turn-on condition changeover switch that is disposed in the cab and switches a condition of turning-on of the approach permission indicator light by the external operation controller, and the external operation controller is configured to always turn off the approach permission indicator light and always turn on the operation indicator light when the information collected into the machine controller is information about attended operation in which the operator rides in the cab and executes operation of the construction machine and is information resulting from operation of the turn-on condition changeover switch.

* * * * *